US005402993A

United States Patent [19]

Hofmann et al.

[11] Patent Number: 5,402,993

[45] Date of Patent: Apr. 4, 1995

[54] IMMERSION CASTING PIPE FOR THIN SLABS

[75] Inventors: Georg Hofmann, Düsseldorf; Lothar Parschat, Ratingen; Fritz P. Pleschiutschnigg, Duisburg; Peter Wahls, Mettmann; Hans Butz, Duisburg; Ulrich Siegers, Berlin, all of Germany

[73] Assignee: Mannesmann Aktiengesellschaft, Dusseldorf, Germany

[21] Appl. No.: 167,897

[22] Filed: Feb. 17, 1994

[30] Foreign Application Priority Data

Jun. 21, 1991 [DE] Germany ..... 41 20 999.0
Dec. 18, 1991 [DE] Germany ..... 41 42 447.6

[51] Int. Cl.[6] ..... B22D 41/50

[52] U.S. Cl. ..... 266/236; 222/606; 164/337

[58] Field of Search ..... 266/236; 222/590, 591, 222/594, 606, 607; 164/335, 337

[56] References Cited

U.S. PATENT DOCUMENTS 4,993,608 2/1991 Thorner ..... 222/607
5,205,343 4/1993 Streubel et al. ..... 222/607

FOREIGN PATENT DOCUMENTS 0403808 12/1990 European Pat. Off. .
0482423 4/1992 European Pat. Off. ..... 222/607
8806932 9/1988 WIPO .
8912519 12/1989 WIPO .

*Primary Examiner*—Scott Kastler
*Attorney, Agent, or Firm*—Cohen, Pontani, Lieberman, Pavane

[57] ABSTRACT

The invention is directed to an immersion casting pipe for feeding molten steel from a casting vessel into a mold having wide side walls and narrow side walls for the production of flat products. The immersion casting pipe has a pipe piece which adjoins the casting vessel and expands in cross section in the direction of the narrow side walls of the mold. The pipe piece is provided with a central base member at the lower end which allows for outlet openings for the melt. For the purpose of developing an immersion outlet which allows higher slab withdrawal speed of up to 6 m/min with slabs measuring 50 to 100 mm in thickness and 600 mm to 2000 mm in width, the inner wall of the portion of the immersion casting pipe which widens in cross section forms flow channels in conjunction with the opposite wall parts of the base member. The axes of the flow channels enclose an angle $\alpha$ between 10° and 22°, where the smaller angle corresponds to a distance of approximately 600 mm between the narrow side walls of the mold and the larger angle corresponds to a distance of 2000 mm or more between the narrow side walls of the mold. The distance between the wide side walls of the mold is 50 to 100 mm.

5 Claims, 2 Drawing Sheets

IMMERSION CASTING PIPE FOR THIN SLABS

BACKGROUND OF THE INVENTION

The invention is directed to an immersion casting pipe.

In the continuous casting of flat products of steel, a casting pipe is used to direct the melt from a feed vessel into a mold. The mold has wide side walls and narrow side walls which maintain a distance of 50 to 100 mm between the wide side walls and define the narrow sides of the slab. The immersion casting pipe has been adapted to the mold format in such a way that the immersion casting pipe first forms a pipe piece which adjoins the casting vessel, then widens in cross section in the direction of the narrow side walls of the mold and narrows in a direction vertical thereto. Conventional immersion outlets have outlet openings which face in the direction of the narrow sides (see DE 37 09 188 A1) or which face more in the casting direction as is known, for example, from EP 0 403 808 A1. Finally, immersion outlets which only have an outlet opening in the casting direction are also known (see *Steel and Iron* (1991), No. 9, page 107). These immersion outlets enable satisfactory operation at a slab withdrawal speed of up to 3 m/min.

It may be observed in practical operation that the melt emerging from the immersion pipe has an unstable flow such that the melt entering the mold rocks back and forth between the right-hand and left-hand defining walls of the immersion outlet. This leads to turbulence at the surface of the casting melt which takes the form of a pulsating up-and-down movement inside the mold. At higher slab withdrawal speeds and consequently higher output through the immersion outlet, whirling occurs on the surface of the casting melt and particles of pulverized cast and slag are entrained in the melt and later occur as nonmetallic inclusions in the cast product. This whirling on the surface of the casting melt is caused at higher outputs by the higher kinetic energy in the stream of molten metal which leads to localized high turbulence in the melt sump or liquid phase. The outlet momentum of the molten stream cannot be uniformly reduced and eliminated in the forms of immersion pipes known from the prior art.

SUMMARY OF THE INVENTION

Therefore, the object of the present invention is to develop an immersion outlet which avoids these disadvantages and allows higher slab withdrawal speeds of up to 6 m/min with slabs having a thickness of 50 to 100 mm and a width of 600 mm to 2000 mm or more.

Pursuant to this object, and others which will become apparent hereafter, one aspect of the present invention resides in an immersion casting pipe of the previously discussed type in which the inner wall of the portion of the immersion casting pipe which widens in cross section forms flow channels together with the opposing wall parts of a base member. The axes of the flow channels enclose an angle $\alpha$ between 10° and 22° with the axis of the immersion pipe, where the smaller angle corresponds to a distance of approximately 600 mm between the narrow side walls of the mold and the larger angle corresponds to a distance of 2000 mm or more between the narrow side walls of the mold. The distance between the wide side walls of the mold being 50 to 100 min.

In a further embodiment of the invention, the angle $\alpha$ is determined by the following formula:

$$\alpha = 1.5 \times \arctan\left(\frac{b}{1.57\,v}\right)$$

where b=mold width in m v=casting speed in m/min.

The invention is explained in more detail with reference to the drawing which shows embodiment examples of the invention.

DETAILED DESCRIPTION OF THE PREFERRED EMBODIMENTS

Figure 1:
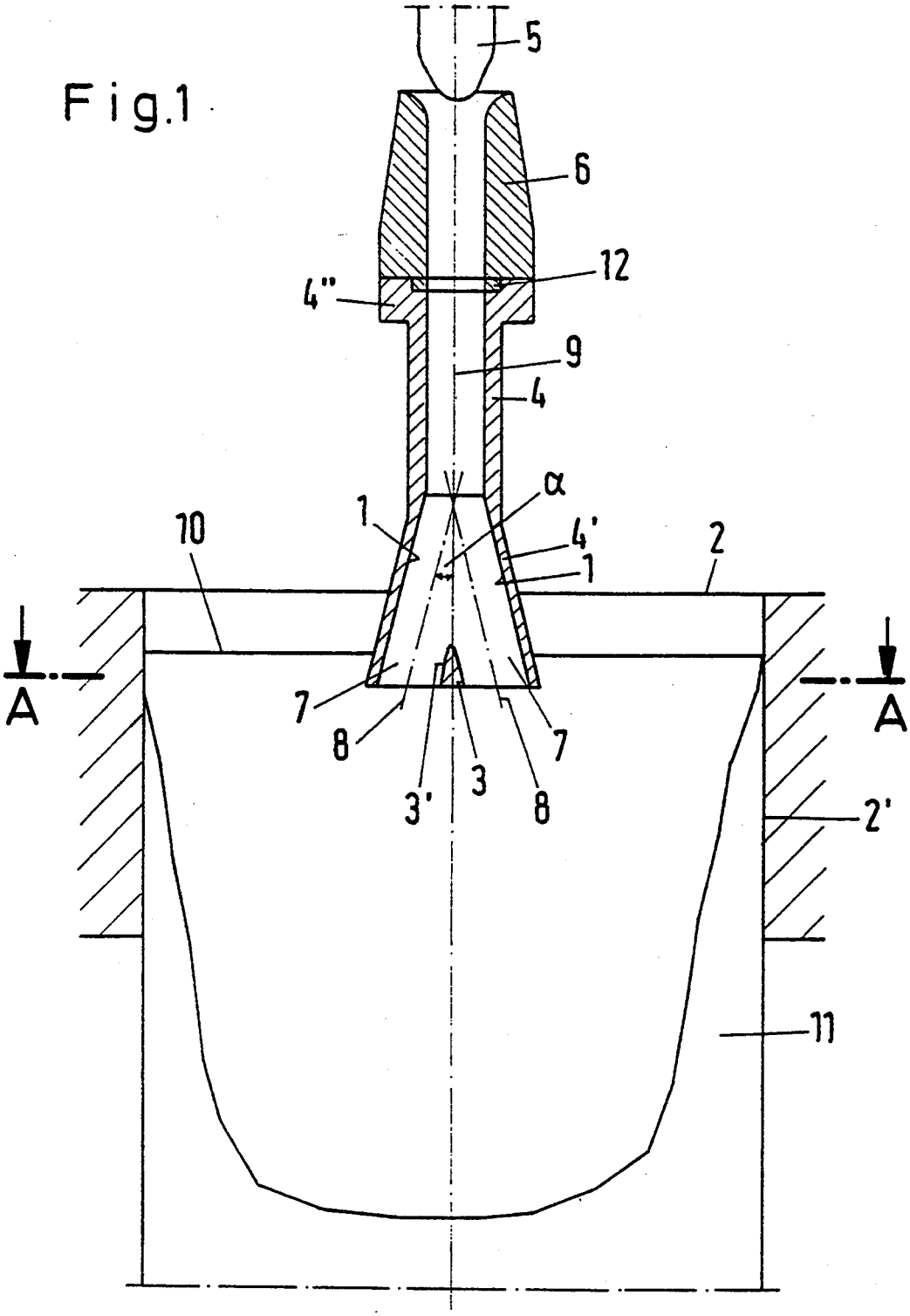
FIG. 1 shows a longitudinal section through the immersion outlet projecting into the mold.
Figure 2:
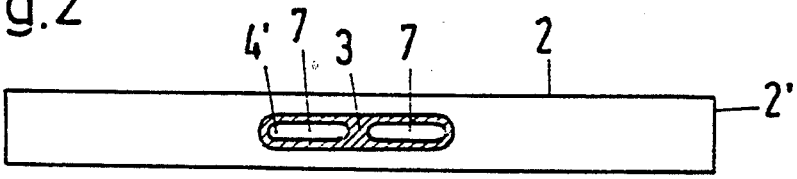
FIG. 2 shows a top view in the sectional plane A—A according to FIG. 1.

According to FIG. 1, an immersion casting pipe 4, 4' projects into a slab mold intended for the continuous casting of thin slabs with wide side walls 2 and narrow side walls 2', this immersion casting pipe 4, 4' projecting beneath the bath surface 10 of the slab 11 being formed in the mold. The immersion casting pipe has an upper tubular portion 4 adjoining another portion 4'. The portion 4' of the immersion casting pipe widens conically in a plane and is provided with a central wedge-shaped base member 3. Together with the inner walls 1 of the widening portion 4', the side surfaces 3+ of the base member 3 which project into the immersion casting pipe form flow channels 7. The axes 8 of the flow channels 7 enclose an angle between 10° and 22° with the axis 9 of the immersion casting pipe. With respect to a mold whose wide side walls 2 have a distance between them of 50 to 100 mm, the angle in question is selected in such a way that the angle of 10° is associated with a distance of approximately 600 mm between the narrow side walls 2' of the mold and the larger angle is associated with a distance of 2000 mm or more between the narrow side walls 2' of the mold.

The outlet openings of the channels 7 are situated in a plane normal to the axis 9 of the immersion casting pipe. However, in another possible construction, the plane of the outlet openings of the channels 7 may also be arranged normal to the axes 8 of the channels 7.

The position of the channels 7 of the portion 4' of the immersion casting pipe is defined by the angle $\alpha$ which is enclosed by one of the channel axes 8 and the axis 9 of the immersion casting pipe.

The angle $\alpha$ is defined according to the following formula:

$$\alpha = 1.5 \times \text{arc tan}\left(\frac{b}{1.57\,v}\right)$$

where b=mold width (distance between narrow sides)

v=casting speed.

To maintain a reasonable number of immersion outlets relative to the large number of possible slab widths, the following simplified correspondence can be made:

| slab width: | angle between the axes 8 and 9: |
|---|---|
| 600 to 1000 mm | 10° to 15° |
| 900 to 1400 mm | 13° to 19° |
| 1200 to 2000 mm | 16° to 22° |

By assigning a correspondence between the position of the axes 8 of the channels 7 and a determined slab width and taking into account the casting speed, the melt in the slab or the solidification front are taken into account in the formation of the flow. When the flow is directed substantially downward and only a slight proportion of the melt flowing in flows opposite the continuous casting direction, this results in a calm, undisturbed surface of the melt bath in the mold. This calm flow is also aided considerably in a further development of the immersion casting pipe in that the common cross-sectional area of the flow-out openings of the channels 7 is larger than the cross-sectional clearance of the inlet opening of the immersion casting pipe 4.

This cross-sectional clearance of the inlet opening of the immersion casting pipe 4 is formed, according to FIG. 1, by the annular gap between the plug 5 and the outlet 6 of a casting vessel, not show. The outlet 6 is incorporated in the base of the casting vessel in a manner known per se and the immersion pipe 4 is flanged on at the base plate of the casting vessel below the outlet 6. A sealing ring 12 is advisably provided at the joint or seam in a recess of the flange 4'' of the immersion casting pipe 4 for the purpose of sealing.

Naturally, it is also possible to use a gate or slide closure for the outlet opening of the casting vessel. In this case, the immersion casting pipe is flanged on below the slide closure in a manner known per se and the cross-sectional area on the inlet side is formed by the relative positions of the openings in the slide plates.

Figure 3:
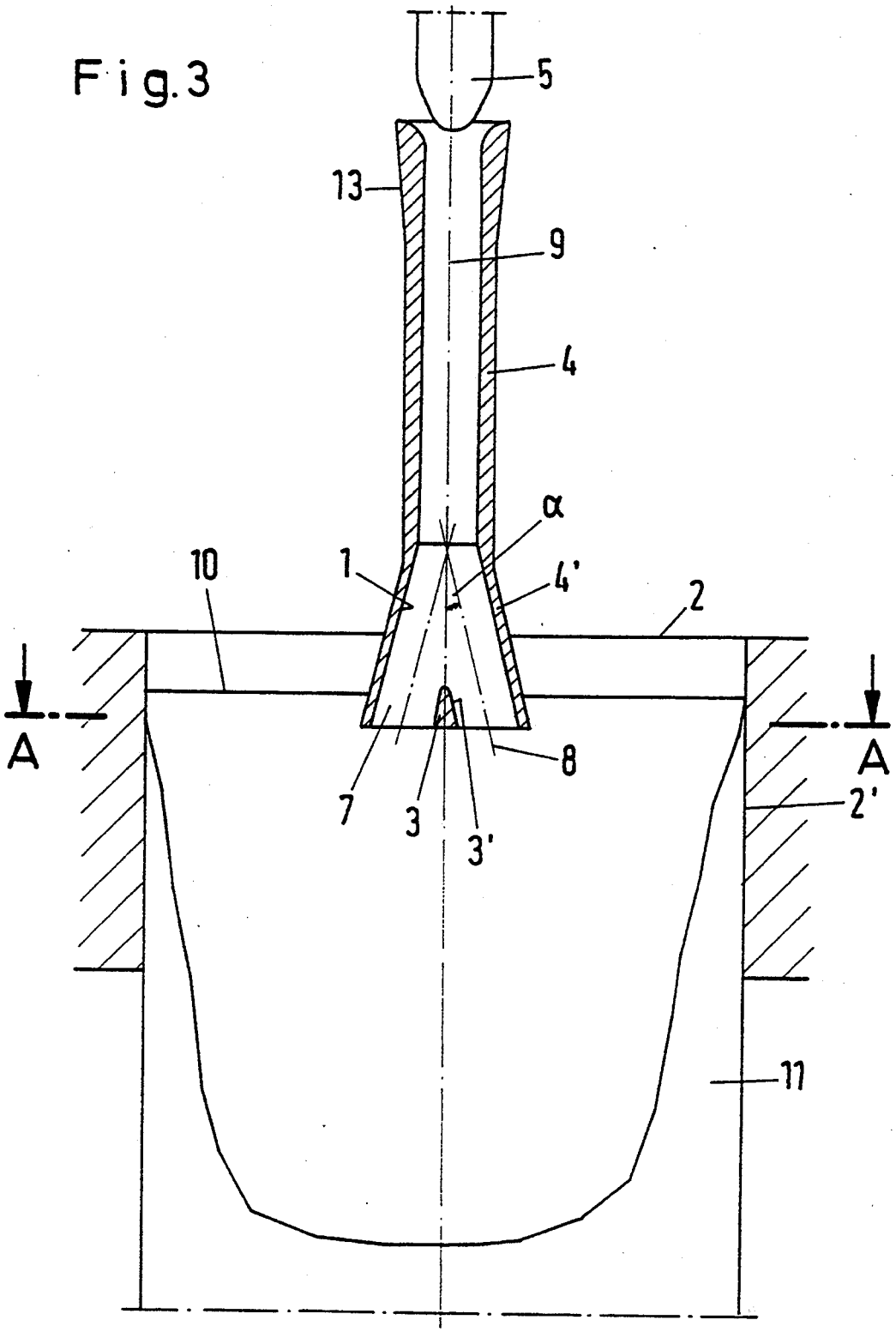
FIG. 3 shows another embodiment of an immersion outlet according to the invention in longitudinal section.

FIG. 3 shows an embodiment form of the immersion casting pipe 4 for insertion in the base of the casting vessel. In this case, the upper portion 13 of the immersion casting pipe 4 which widens outward conically in circumference corresponds to the outlet 6 according to the view shown in FIG. 1.

We claim:

1. An immersion casting pipe for feeding molten steel from a casting vessel into a mold having wide side walls and narrow side walls for producing flat products, comprising: a pipe piece which adjoins the casting vessel and has a portion with a cross section that expands in a direction of the narrow side walls of the mold, the pipe piece having a lower end and an axis; and, a central base member provided at the lower end of the pipe piece so as to form two outlet openings for the molten steel, the portion of the pipe piece which widens in cross section having an inner wall that forms two flow channels together with opposing wall portions of the base member, the flow channels each having an axis that encloses an angle $\alpha$ between 10° and 22° with the axis of the pipe piece, the smaller angle of 10° corresponding to a distance of approximately 600 mm between the narrow side walls or the mold and the larger angle of 22° corresponding to a distance of at least 2000 mm between the narrow side walls of the mold, the wide side walls of the mold being separated by a distance of 50 to 100 mm.

2. An immersion casting pipe according to claim 1, wherein the angle $\alpha$ equals:

$$1.5 \times \arctan\left(\frac{b}{1.57\,v}\right)$$

wherein b=mold width in m v=casting speed in m/min.

3. An immersion casting pipe according to claim 1, wherein the outlet openings of the flow channels are arranged in a plane normal to the axis of the pipe piece.

4. An immersion casting according to claim 1, wherein the outlet openings of the flow channels are arranged in a planes normal to respective axes of the flow channels.

5. An immersion casting pipe according to claim 1, wherein the pipe piece has an inlet opening with a free cross-sectional area, the outlet openings having a common cross-sectional area that is larger than the free cross-sectional area of the inlet opening.

* * * * *

UNITED STATES PATENT AND TRADEMARK OFFICE
CERTIFICATE OF CORRECTION

PATENT NO. : 5,402,993
DATED : April 4, 1995
INVENTOR(S) : Georg Hofmann, et al.

It is certified that error appears in the above-identified patent and that said Letters Patent is hereby corrected as shown below:

Title page,
After "[21]" please insert the following:

| | | |
|---|---|---|
| [22] | PCT Filed: | 22 Jun 92 |
| [86] | PCT No.: | PCT/DE92/00517 |
| | §371 Date: | 17 Feb 94 |
| | §102(e) Date: | 17 Feb 94 |
| [87] | PCT Pub. No.: | WO 93/00191 |
| | PCT Pub. Date: | 7 Jan 93 |

Signed and Sealed this

Twenty-fourth Day of October, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,402,993

DATED : April 4, 1995

INVENTOR(S) : Georg Hofmann et al.

It is certified that error appears in the above-identified patent and that said Letters Patent is hereby corrected as shown below:

On title page, item

[73] Assignee:

Mannesmann Aktiengesellschaft,
Düsseldorf, Germany;

Feuerfestwerk Bad Hönningen GmbH,
Bad Hönningen, Germany and

Giovanni Arvedi,
Cremona, Italy

Signed and Sealed this

Ninth Day of July, 1996

*Attest:*

*Attesting Officer*

BRUCE LEHMAN

*Commissioner of Patents and Trademarks*